US008702267B2

(12) United States Patent
Robinson

(10) Patent No.: US 8,702,267 B2
(45) Date of Patent: Apr. 22, 2014

(54) FLASHLIGHT WITH MAGNETS

(75) Inventor: Glenn Robinson, Coral Springs, FL (US)

(73) Assignee: IBT Holdings, LLC, Deerfield Beach, FL (US)

( * ) Notice: Subject to any disclaimer, the term of this patent is extended or adjusted under 35 U.S.C. 154(b) by 72 days.

(21) Appl. No.: 12/807,329

(22) Filed: Sep. 2, 2010

(65) Prior Publication Data

US 2012/0057334 A1 Mar. 8, 2012

(51) Int. Cl.
*F21L 4/00* (2006.01)

(52) U.S. Cl.
USPC ..... 362/191; 362/157

(58) Field of Classification Search
USPC ..... 362/157, 190, 191, 202, 205, 206
See application file for complete search history.

(56) References Cited

U.S. PATENT DOCUMENTS

| | | | | | |
|---|---|---|---|---|---|
| 1,211,465 | A * | 1/1917 | McGuckin | ..... | 362/208 |
| 2,097,222 | A * | 10/1937 | Spender et al. | ..... | 362/187 |
| 4,220,304 | A * | 9/1980 | Wong et al. | ..... | 248/206.5 |
| 5,339,229 | A * | 8/1994 | Snyder | ..... | 362/208 |
| 5,440,465 | A * | 8/1995 | Hasness | ..... | 362/191 |
| 6,244,723 | B1 * | 6/2001 | Talamo | ..... | 362/208 |
| 7,140,748 | B2 * | 11/2006 | Chien | ..... | 362/205 |
| 7,347,583 | B2 * | 3/2008 | Britt | ..... | 362/206 |
| 2001/0000685 | A1 * | 5/2001 | Maglica | ..... | 362/207 |

* cited by examiner

*Primary Examiner* — Julie Bannan
(74) *Attorney, Agent, or Firm* — Dan DeLa Rosa

(57) ABSTRACT

A flashlight with magnets is provided, and the flashlight comprises: a housing having an external surface, the housing having top and bottom portions, and the top portion comprising a light bulb; a compartment in the housing for storing a power source; and at least one magnet attached to the external surface of the housing to allow the flashlight to be attached to a metallic surface.

12 Claims, 5 Drawing Sheets

FLASHLIGHT WITH MAGNETS

BACKGROUND OF THE INVENTION

1. Field of the Invention

This invention relates to a flashlight having at least one magnet or a plurality of magnets strategically placed throughout its housing so that the flashlight may be attached to a metallic surface such as metallic tool boxes and cases, metallic working surface, other metallic tools, etc.

2. Description of the Related Art

There are various patents covering flashlights with mechanisms such as clips and straps and other device that allows a flashlight to be attached to a working surface or a tool box or other desired areas.

SUMMARY OF THE INVENTION

In one embodiment, the present invention provides for a flashlight comprising: a housing having an external surface, the housing having top and bottom portions, and the top portion comprising a light bulb; a compartment in the housing for storing a power source; and at least one magnet attached to the external surface of the housing to allow the flashlight to be attached to a metallic surface.

In another embodiment, the magnet has the strength (usually measured in Tesla) to support the flashlight when the flashlight is attached to the metallic surface.

In yet another embodiment, the flashlight further comprises a plurality of magnets. In still another embodiment, the top portion of the housing comprises at least one transparent lens to allow light emitted by the bulb to be shined by the flashlight. In still another embodiment, the top portion of the housing comprises at least one translucent lens to allow light emitted by the bulb to be shined by the flashlight.

In still yet another embodiment, the flashlight further comprises a reflector situated adjacent the bulb to further amply and reflect light emitted by the bulb. In a further embodiment, the flashlight further comprises at least one on/off button situated on the surface of the housing. In yet a further embodiment, the flashlight further comprises at least one power source, and the power source is a battery. The present invention may use any type or size of batteries.

In still a further embodiment, the top portion of the housing comprises an extended top portion, and the extension top portion has a surface area, and the magnet is situated on the surface area of the extended top portion. In still yet a further embodiment, the bottom portion of the housing comprises an extended bottom portion, and the extension bottom portion has a surface area, and the magnet is situated on the surface area of the extended bottom portion.

In another further embodiment, the bottom portion of the housing comprises an extended bottom portion, and the extension bottom portion has a surface area, and the flashlight comprising a second magnet, the second magnet is situated on the surface area of the extended bottom portion.

In another embodiment, the first and second magnets are generally parallel to one another. In still another embodiment, the extended top and bottom portions are generally parallel to one another.

In yet another embodiment, the present invention provides for a flashlight comprising: a housing having top and bottom portions, the top portion comprises a light bulb, and the top portion of the housing comprising an extended top portion, the extension top portion has an external top surface, the bottom portion of the housing comprised an extended bottom portion, the extension bottom portion having an external bottom surface; a compartment in the housing for storing a power source; and at least two magnets, a first magnet is attached to the external top surface of the extended top portion of the top portion of the housing, a second magnet is attached to the external bottom surface of the extended bottom portion of the bottom portion of the housing, and the magnets are designed to allow the flashlight to be attached to a metallic surface.

In a further embodiment, the present invention relates to a flashlight comprising: a housing having an external surface, the housing has top and bottom portions, the top portion comprising a light bulb; and a plurality of magnets strategically attached to the external surface of the housing to allow the flashlight to be attached to a metallic surface.

In another embodiment, the housing is hollow for retaining a power source and the flashlight further comprising a cap, at least one extended top portion with at least one magnet, and at least one extended bottom portion with at least one magnet, the bottom extended portion being rotatably moveable about an axis of said housing of said flashlight. This is to allow the magnet on the extended bottom portion to be aligned with the magnet on the extended top portion after the cap has been closed. In yet another embodiment, the extended bottom portion is attached to the cap.

In still another embodiment, the extended top portion comprises at least one ring which is designed to rotate about the housing of the flashlight, and the magnet is attached to at least a portion of the ring. In still yet another embodiment, extended bottom comprises at least one ring which is designed to rotate about the housing of the flashlight, and the magnet is attached to at least a portion of the ring.

In a further embodiment, the present invention provides for a flashlight comprising: a housing having top and bottom portions, the top portion comprising a light bulb, said top portion of said housing comprises an extended top portion, the extended top portion having an external top surface, the bottom portion of the housing comprises an extended bottom portion, and the extension bottom portion has an external bottom surface; a compartment in the housing for storing a power source; and at least two magnets, a first magnet attached to the external top surface of the extended top portion of the top portion of the housing, a second magnet attached to the external bottom surface of the extended bottom portion of the bottom portion of the housing, the magnets are designed to allow the flashlight to be attached to a metallic surface.

In a further embodiment, the extended bottom portion is moveable around the housing of the flashlight and the extended top portion is stationary. In yet a further embodiment, the extendable top portion is moveable around the housing of the flashlight and the extended bottom portion is stationary.

In still a further embodiment, the extended bottom portion is moved to position its magnet to be aligned with the magnet on the extended top portion.

In another further embodiment, the present invention provides for a flashlight comprising: a housing having an external surface, and the housing having top and bottom portions, the top portion comprising a light bulb, the top portion having a top ring, the bottom portion having a bottom ring being rotatable about the housing of the flashlight; and at least two magnets, each magnet is strategically attached to an external surface on each of the rings.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
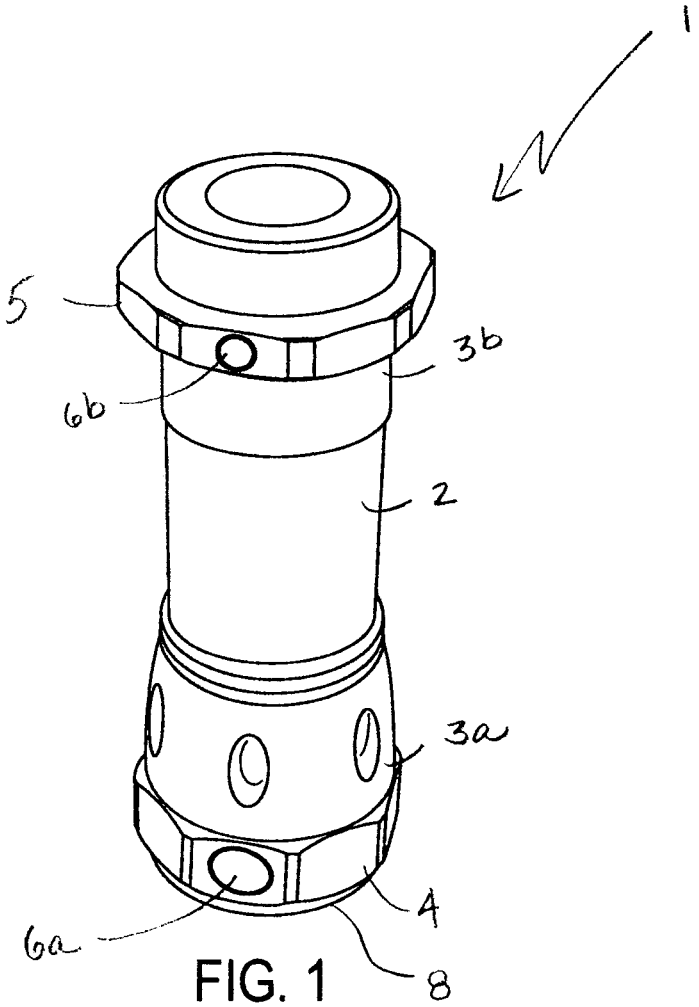
FIG. 1 is perspective view of the flashlight of the present invention with the strategically placed magnets.
Figure 2:
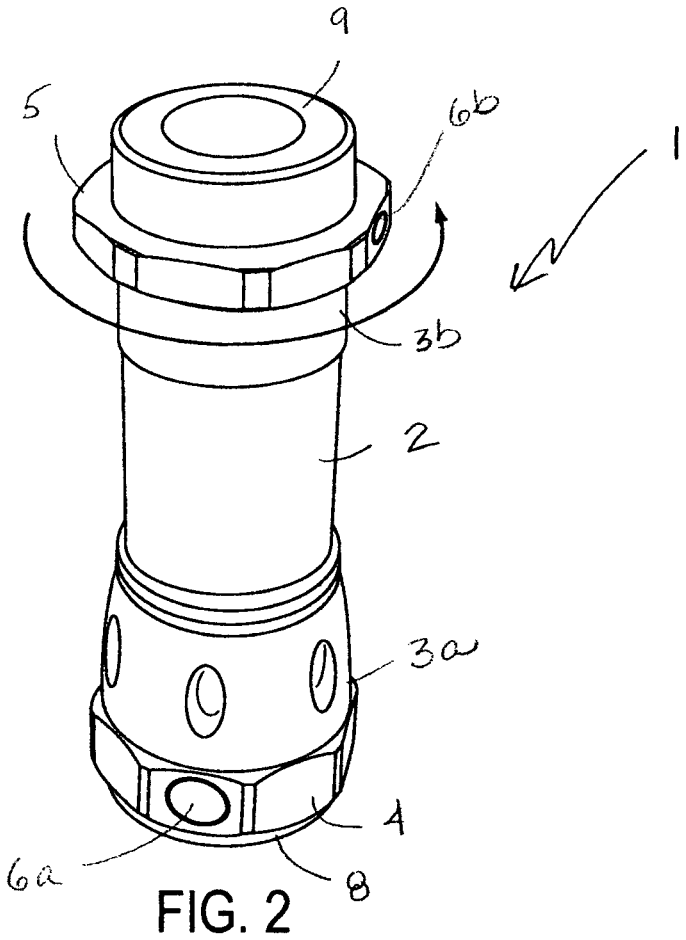
FIG. 2 is perspective view of the flashlight with the rotating bottom ring.
Figure 3:
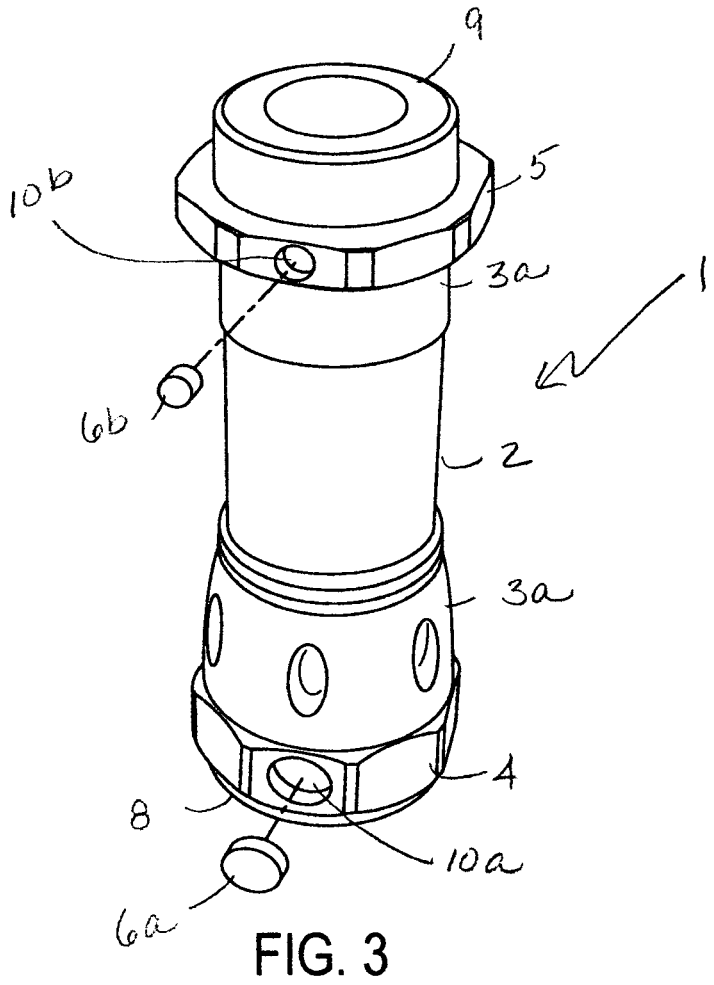
FIG. 3 is a perspective view of the flashlight with the rotating top ring and the showing of the insertion of the magnets.
Figure 4:
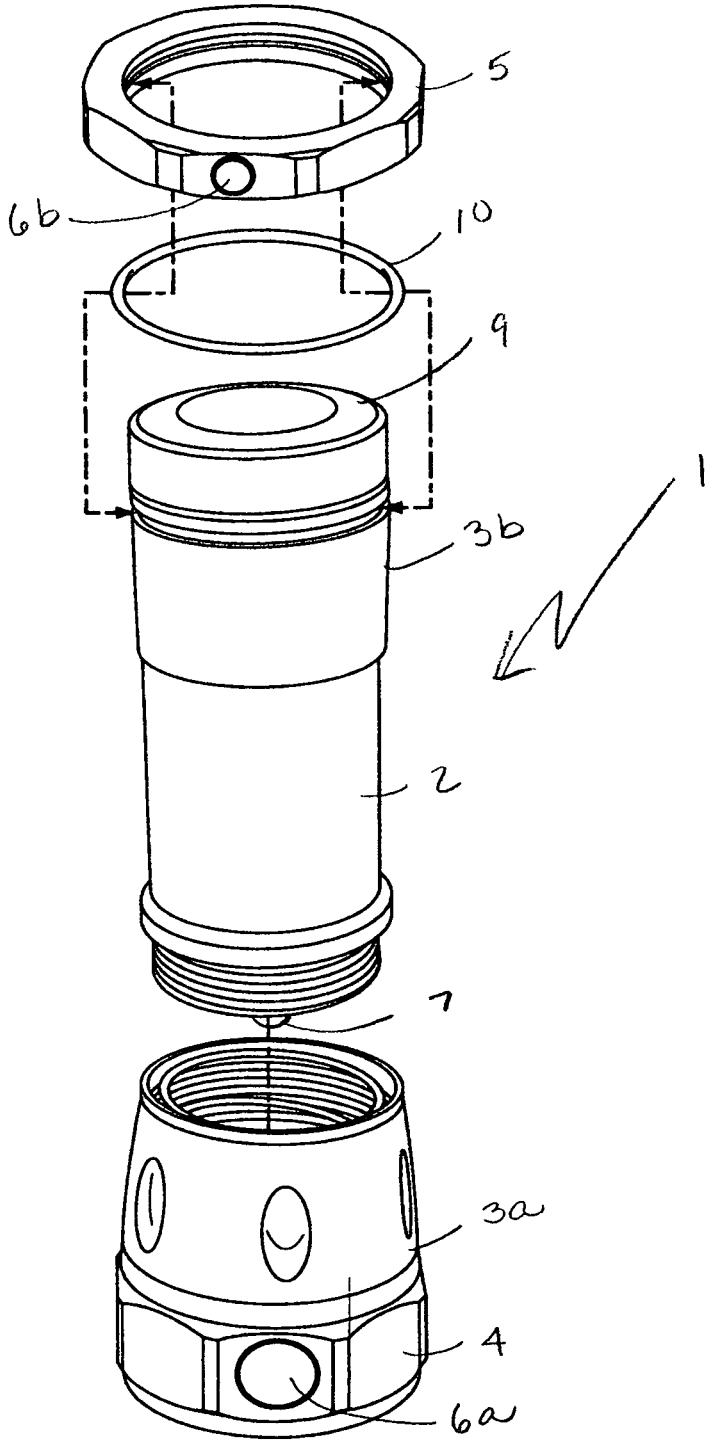
FIG. 4 is an exploded perspective view of the flashlight of the present invention.

FIGS. 1-4 illustrate the flashlight 1 of the present invention comprising a housing 2 with a top portion 3*a* and a bottom portion 3*b*. The top portion 3*a* has a first ring 4 and the bottom portion 3*b* has a second ring 5. There are at least two magnets, 6*a* and *b* respectively. The first magnet 6*a* is attached to a surface of the first ring 4. The second magnet 6*b* is attached to a surface of the second ring 5. The magnets, 6*a* and 6*b*, are inserted into two cavities, 10*a* and 10*b*, situated on an outer surface of the two rings, 4 and 5 respectively (as shown in FIG. 3). The top portion 3*a* of the housing 2 has a light bulb 7 (as shown in FIG. 4) or LED light and there is a transparent or translucent lens 8 over the bulb 7.

In one embodiment, FIGS. 2 and 4 depicts the ring 5 being rotatably moveable about an axis of the housing 2 and the ring 4 is stationary. The ring 5 and a washer 10 may be attached to a cap 9. The bottom portion 3*b* of the housing 2 is hollow to allow for storage of a power source such as a battery. When the user inserts the battery, the cap 9 is closed and for ease, the ring 5 is moveable so that the magnet 6*b* will align with the magnet 6*a* on the ring 4. The magnets, 6*a* and 6*b*, work best when they are aligned with one another or generally parallel to one another.

In another embodiment, the ring 4 may be moveable and the ring 5 is stationary. In yet another embodiment, the ring 4 and ring 5 are both moveable.

Figure 5:
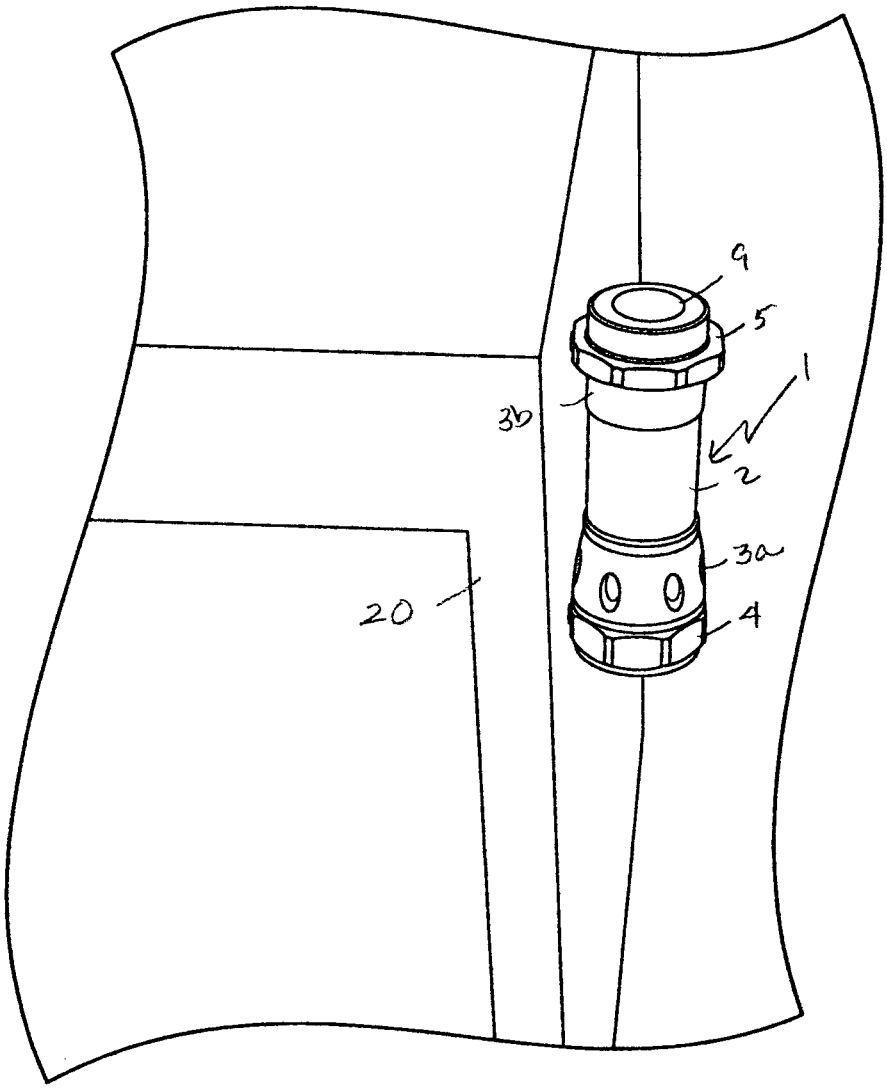
FIG. 5 is a perspective view of flashlight attached to a metallic surface.

The magnets, 6*a* and 6*b*, may be placed on any of the outer surfaces of the rings, 4 and 5 and at times, the housing 2 of the flashlight 1. FIG. 5 shows how the magnets, 6*a* and 6*b* allow the flashlight 1 to be attached to a metallic surface 20.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A flashlight comprising:

a housing having an external surface, top and bottom portions, and at least one compartment for storing a power source;

at least one light bulb;

a removable top cap designed to engage with said top portion of said housing and to allow access to said compartment and said light bulb;

a first ring mounted to said top cap and being independently rotatable relative to said cap, said first ring having a first planar surface;

a second ring mounted to said bottom portion of said housing and being independently rotatable relative to said housing, said second ring having a second planar surface; and at least two magnets, a first magnet being inserted into a first cavity on said first planar surface of said first ring and a second magnet being inserted into a second cavity on said second planar surface of said second ring, said first and second rings being designed to be rotated to allow said first and second magnets to align with one another and thereby to allow said flashlight to be attached to a metallic surface.

2. The flashlight of claim 1 wherein said magnet has the strength to support said flashlight when said flashlight is attached to the metallic surface.

3. The flashlight of claim 1 wherein said top cap comprises at least one transparent lens to allow light emitted by said bulb to be shined by said flashlight.

4. The flashlight of claim 1 wherein said top cap comprises at least one translucent lens to allow light emitted by said bulb to be shined by said flashlight.

5. The flashlight of claim 1 further comprises a reflector situated adjacent said bulb to further amply and reflect light emitted by said bulb.

6. The flashlight of claim 1 wherein said top cap comprises at least one compartment, said bulb is situated within said compartment in said top cap.

7. The flashlight of claim 1 wherein said bulb is situated within said housing.

8. The flashlight of claim 1 further comprises at least one power source, and at least one on/off button situated on said external surface of said housing, said power source is a battery.

9. The flashlight of claim 8 further comprises a bottom cap for accessing said power source.

10. A flashlight comprising:

a housing having top and bottom portions, and at least one compartment for storing a power source, said top portion of said housing comprising a light bulb;

a cap designed to engage with said top portion of housing and to allow access to said light bulb and said power source;

a first ring mounted to said cap and being independently rotatable relative to said cap, said first ring haying a first planar surface;

a second ring mounted to said bottom of said housing and being independently rotatable relative to said housing, said second ring having a second planar surface; and at least two magnets, a first magnet being situated on said first planar surface of said first ring and a second magnet being situated on said second planar surface of said second ring, said first and second rings being designed to be rotated to allow said first and second magnets to align with one another and thereby to allow said flashlight to be attached to a metallic surface.

11. The flashlight of claim 10 further comprises at least one lens and at least one reflector.

12. The flashlight of claim 10 further comprises at least one power source, said power source is a battery.

* * * * *